US005818327A

United States Patent [19]

Berg

[11] Patent Number: 5,818,327

[45] Date of Patent: Oct. 6, 1998

[54] DISPLAY APPARATUS FOR BASKETBALL

[76] Inventor: Thomas H. Berg, 3713 S. 48th St., Lincoln, Nebr. 68506

[21] Appl. No.: 756,066

[22] Filed: Nov. 25, 1996

[51] Int. Cl.[6] ..... G08B 23/00

[52] U.S. Cl. ..... 340/323 R; 273/DIG. 26; 40/573

[58] Field of Search ..... 340/323 R, 815.47, 340/815.49, 815.55, 815.56, 815.73, 815.74, 463, 464, 468; 273/DIG. 26; 362/29, 242, 251; 40/452, 464, 573

[56] References Cited

U.S. PATENT DOCUMENTS

| | | | |
|---|---|---|---|
| 2,866,175 | 12/1958 | Slater | 340/464 |
| 3,302,192 | 1/1967 | Laughlin | 340/323 R |
| 3,399,400 | 8/1968 | Lucka | 340/323 R |
| 3,868,671 | 2/1975 | Maguire et al. | 340/323 |

*Primary Examiner*—Jeffery Hofsass
*Assistant Examiner*—Julie Lieu
*Attorney, Agent, or Firm*—Zarley,McKee,Thomte Voorhees & Sease; Mark D. Frederiksen

[57] ABSTRACT

A display apparatus includes a housing having a front panel with first, second, third, and fourth illuminatable indicia thereon. The first and fourth indicia are located at opposing ends of the panel and are identical, the second and third indicia located inwardly of the first and fourth indicia respectfully and are also identical. First and second operable switches are mounted on the housing, with the first switch connected to the first and second indicia for selectively illuminating either the first indicia, the second indicia, or neither indicia. The second switch is connected to the third and fourth indicia and operable to selectively illuminate the third indicia, the fourth indicia, or neither indicia. The first and second switches are operable independently of one another.

10 Claims, 2 Drawing Sheets

DISPLAY APPARATUS FOR BASKETBALL

TECHNICAL FIELD

The present invention relates generally to display apparatus utilized in sports, and more particularly to an improved electronically display apparatus for indicating the occurrence of bonus fouls in a basketball game.

BACKGROUND OF THE INVENTION

Various display apparatus are utilized during basketball games to keep track of a variety of information types. For example, U.S. Pat. No. 3,868,671 to Hugh Maguire discloses a foul indicia display apparatus for indicating the number of fouls which are charged to a particular player, as well as other related information. Similarly, display apparatus are provided with arrows pointing in opposite directions, to indicate the possession of the ball under the "alternate possession" rule.

A recent change to rules in basketball entitle a team to a bonus free throw for fouls committed by the opposing team upon the accumulation of a sufficient number of fouls. This first bonus accumulation is typically designated as "one plus one", and entitles the player to shoot one foul, and permits a second attempt if the first free throw is successful.

Basketball rule changes now include a second type of bonus free throw, when the team fouls accumulate beyond the "one plus one" bonus level to a "two shot" bonus level. Upon reaching the "two shot" level, the player is entitled to two free throws, regardless of his success on the first free throw.

While previous devices have displayed other types of foul information, there is no known apparatus which permits the continuous display of each team's accumulation of fouls into either the "one plus one" or "two shot" bonus free throw situation.

SUMMARY OF THE INVENTION

It is therefore a general object of the present invention to provide an improved display apparatus for displaying bonus free throw situations.

Another object is to provide an improved display apparatus which will selectively display: (1) a non-bonus situation; (2) a "one plus one" bonus situation, or (3) a "two shot" bonus situation, for each team during a basketball game.

Yet a further object of the present invention is provide an improved display apparatus which is simple to operate and economical to manufacture.

These and other objects of the present invention will be apparent to those skilled in the art.

The display apparatus of the present invention includes a housing having a front panel with first, second, third, and fourth illuminatable indicia thereon. The first and fourth indicia are located at opposing ends of the panel and are identical, the second and third indicia located inwardly of the first and fourth indicia respectfully and are also identical. First and second operable switches are mounted on the housing, with the first switch connected to the first and second indicia for selectively illuminating either the first indicia, the second indicia, or neither indicia. The second switch is connected to the third and fourth indicia and operable to selectively illuminate the third indicia, the fourth indicia, or neither indicia. The first and second switches are operable independently of one another.

DESCRIPTION OF THE PREFERRED EMBODIMENT

Figure 1:
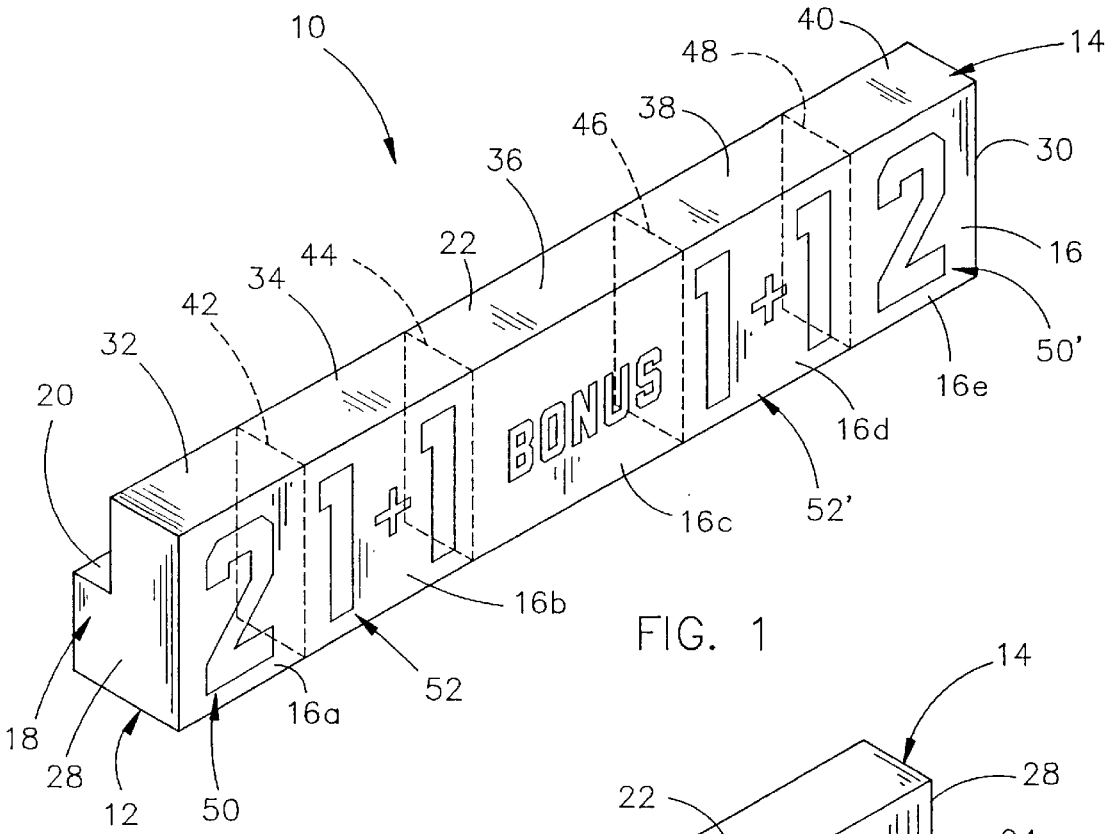
FIG. 1 is a perspective view of the front of the display apparatus of the present invention.

Referring now to the drawings, in which similar or corresponding parts are identified with the same reference numeral and more particularly to FIG. 1, the display apparatus of the present invention is designated generally at 10 and includes a housing 12 having a forward section 14 with a front panel 16, and a rearward section 18 having a top wall 20 at a vertical height lower than a top wall 22 of forward section 14.

Figure 2:
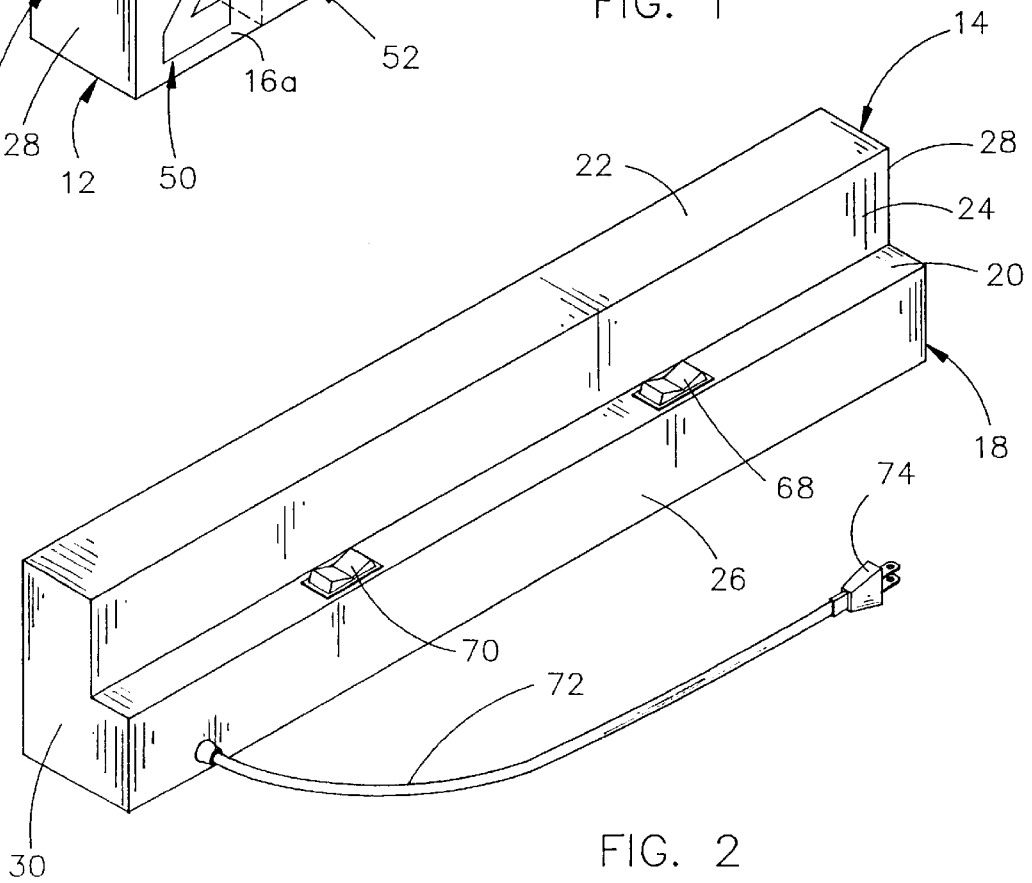
FIG. 2 is a rearward perspective view of the display apparatus.

Referring now to FIG. 2, housing forward section 14 includes a rearward wall 24 extending from forward section top wall 22 to rearward section top wall 20. Rearward section 18 includes a rearward wall 26 extending downwardly from a rearward edge of rearward section top wall 20. Side walls 28 and 30 are generally L-shaped and enclose the sides of forward and rearward sections 14 and 18.

Figure 3:
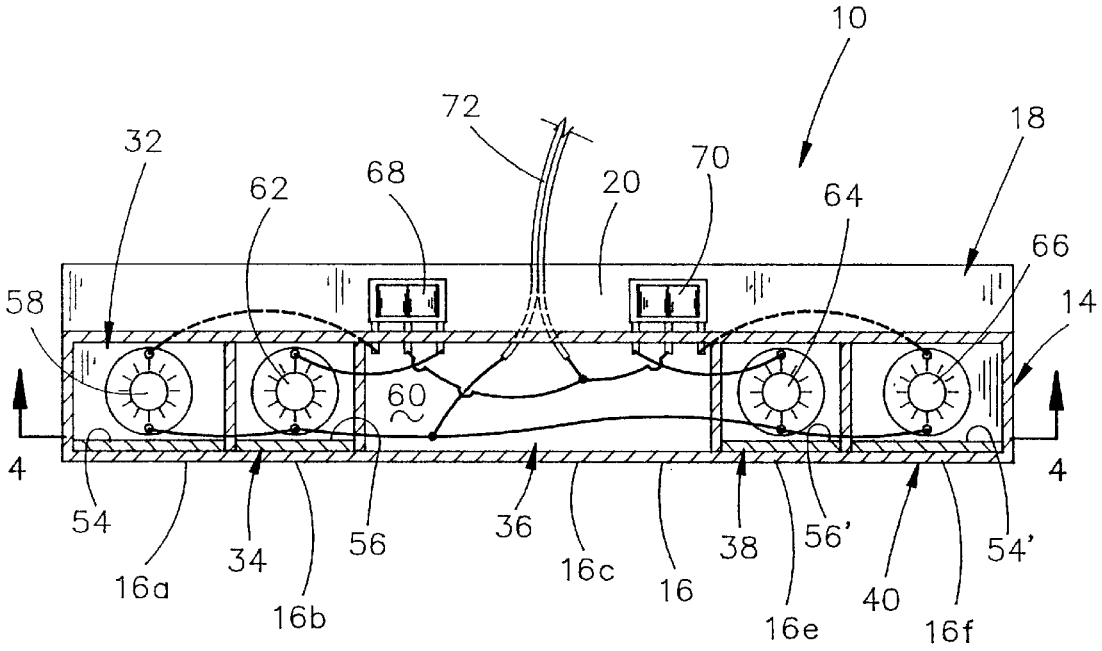
FIG. 3 is a top plan view of the display apparatus with a forward upper portion removed to display the interior thereof.
Figure 4:
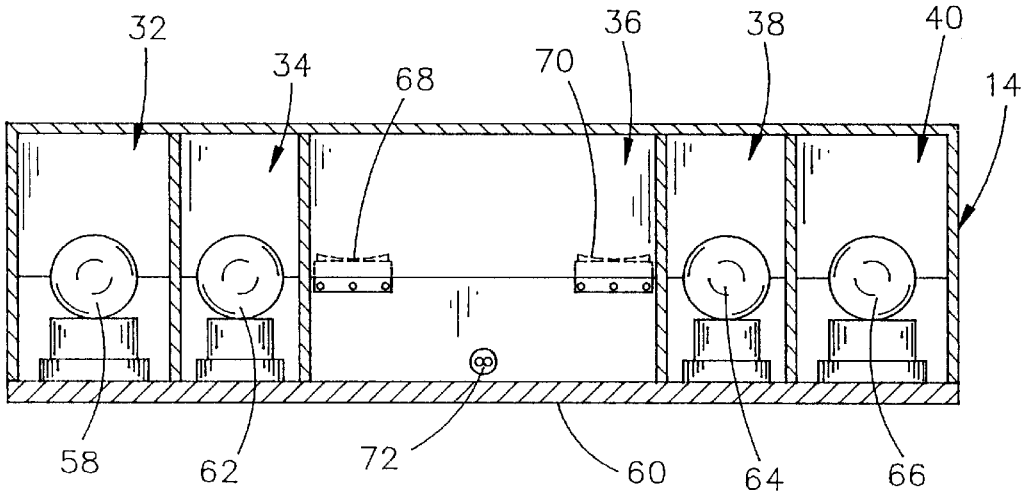
FIG. 4 is a vertical sectional view taken at lines 4—4 in FIG. 3, with the wires removed for clarity.

Referring now to FIGS. 3 and 4, the interior cavity of forward section 14 is divided into five individual cells 32, 34, 36, 38, and 40. Cells 32 and 34 are separated by a light baffle 42, cells 34 and 36 are separated by a second light baffle 44, cells 36 and 38 are separated a third baffle 46, and cells 38 and 40 are separated by fourth baffle 48.

Referring once again to FIG. 1, it can be seen that front panel 16 may be divided into five sections 16*a*, 16*b*, 16*c*, 16*d*, and 16*e*, each located adjacent the forward portion of cells 32, 34, 36, 38, and 40, respectively. Section 16*a* is opaque, and has an opening 50 formed therethrough in the shape of desired indicia. In FIG. 1, this indicia is the numeral "2". Similarly, section 16*b* includes openings formed to represent the indicia "one plus one" and designated generally at 52. The same "one plus one" indicia 52' is formed in section 16*d*, and indicia 50' formed in section 16*e* is the same as indicia 50 formed in section 16*a*. Light baffles 42, 44, 46, and 48 are located so as to enclose each cell 32, 34, 36, 38, and 40 to prevent the passage of light between the cells.

A colored translucent panel 54 is mounted on the interior surface of section 16*a* to provide color to the indicia 50 (shown in FIG. 1) when a lamp is illuminated within cell 32. A similarly colored panel 54' is mounted on the interior surface of section 16*e*. A second colored translucent panel 56 is mounted on the interior surface of section 16*b* to illuminate a different color than panel 54 when a lamp is illuminated in cell 34. A panel 56' of the same color as panel 56 is mounted similarly on the interior surface of section 16*d*.

A first lamp 58 is mounted within cell 32 on the floor 60 of display apparatus 10. A second lamp 62 is mounted within cell 34, a third lamp 64 is mounted within cell 38 and a fourth lamp 66 is mounted within cell 40, all on floor 60. A pair of rocker switches 68 and 70 are operably mounted on top wall 20 of rearward section 18 and are electrically interconnected between lamps 58, 62, 64, and 66, and an electrical cord 72, as described in more detail hereinbelow. Rocker switches 68 and 70 are of a conventional type having a center off position, a first on position toggled to the left, and a second on position toggled to the right. The first and second on positions for rocker switches 68 and 70 are independent of one another, and cannot be simultaneously activated. In addition, rocker switches 68 and 70 are electrically connected to electrical cord 72 so as to be independently operable from each other.

In operation, display apparatus 10 is supported on a table along the side of a basketball court, and electrical cord 72 (shown in FIG. 2) is connected to a power outlet via plug 74. Indicia 50 and 52 are located adjacent a left end of front panel 16, while indicia 50' and 52' are located adjacent a right end of front panel 16, to indicate the affiliation of indicia with the end of the basketball court for the particular team. If the home team is situated at the left end of the basketball court, indicia 50 and 52 would be used to display foul situations for the home team, while indicia 50' and 52' would be utilized to display foul situations for the visiting team. Rocker switches 68 and 70 are initially positioned in the center off position so that none of the printed indicia 50, 50', 52, or 52' are illuminated.

Upon the accumulation of team fouls to a predetermined level, the "one plus one" indicia 52 is illuminated by moving the appropriate rocker switch 68 or 70 to the first "on" position. Indicia 52 is continuously illuminated until that team reaches the second level of total fouls, at which time the rocker switch is moved to the second "on" position, illuminating indicia 50, and removing illumination from indicia 52. Rocker switch 68 would be maintained in the second "on" position until the end of the particular time period for which fouls are accumulated.

Independently, rocker switch 70 would be moved to the first on position and thence the second on position as the opposing team accumulated fouls. Officials may quickly and easily determine the appropriate number of bonus free throws for the team shooting foul shots.

Whereas the invention has been shown and described in connection with the preferred embodiments thereof, many modifications, substitutions and additions may be made which are within the intended broad scope of the appended claims.

I claim:

1. A basketball bonus foul shot display apparatus, comprising:

a housing having a front panel with an exterior display surface and right and left ends;

said front panel having a first section located adjacent the left end, a second section adjacent and to the right of the first section, a third section adjacent and to the right of the second section, a fourth section adjacent and to the right of the third section, and a fifth section between the right end and the fourth section;

first illuminatable indicia in said first section having means for selectively illuminating the indicia connected thereto;

second illuminatable indicia in said second section having means for selectively illuminating the indicia connected thereto;

third illuminatable indicia in said fourth section having means for selectively illuminating the indicia connected thereto;

fourth illuminatable indicia in said fifth section having means for selectively illuminating the indicia connected thereto;

said first, second, third, and fourth indicia indicating the number of foul shots permitted in a "bonus" situation of a basketball game;

said means for illuminating said first and second indicia both connected to a first operable switch;

said first switch being selectively operable among a first "on" position, wherein only the first indicia is illuminated, a second "on" position, wherein only the second indicia is illuminated, and an "off" position wherein neither the first or second indicia are illuminated;

said means for illuminating said third and fourth indicia both connected to a second operable switch operable independent of the first switch;

wherein the second switch is selectively operable among a first "on" position, wherein only the fourth indicia is illuminated, a second "on" position, wherein only the third indicia is illuminated, and an "off" position wherein neither the third or fourth indicia are illuminated; and a power source electrically connected to the switches and the means for illuminating the first, second, third and fourth indicia.

2. The display apparatus of claim 1, wherein the first and fourth indicia are identical, and wherein the second and third indicia are identical.

3. The display apparatus of claim 2, wherein the first, second, third, and fourth indicia are illuminated in color, and wherein the color of the first indicia is different than the color of the second indicia, and wherein the color of the third indicia is different than the color of the fourth indicia.

4. The display apparatus of claim 3, wherein the color of the first and fourth indicia are identical, and wherein the color of the second and third indicia are identical.

5. The display apparatus of claim 4, wherein said means for illuminating the first indicia includes a first lamp electrically connected to the first switch, and operable to illuminate only when the first switch is in the first on position;

wherein said means for illuminating the second indicia includes a second lamp electrically connected to the first switch, and operable to illuminate only when the first switch is in the second on position;

wherein said means for illuminating the third indicia includes a third lamp electrically connected to the second switch, and operable to illuminate only when the second switch is in the second on position;

wherein said means for illuminating the fourth indicia includes a fourth lamp electrically connected to the second switch, and operable to illuminate only when the second switch is in the first on position; and wherein said front panel is opaque, and said first, second, third and fourth indicia include openings formed through the opaque panel to permit light passage therethrough upon illumination of an associated lamp.

6. The display apparatus of claim 5, further comprising colored translucent panels positioned between the indicia and the lamp associated with the indicia, to illuminate said indicia in color.

7. The display apparatus of claim 6, further comprising a first light baffle between the first and second lamps, a second light baffle between the second and third lamps, and a third light baffle between the third and fourth lamps, said baffles substantially isolating light from the lamps with their associated indicia.

8. The display apparatus of claim 1, wherein said means for illuminating the first indicia includes a first lamp electrically connected to the first switch, and operable to illuminate only when the first switch is in the first on position;

wherein said means for illuminating the second indicia includes a second lamp electrically connected to the first switch, and operable to illuminate only when the first switch is in the second on position;

wherein said means for illuminating the third indicia includes a third lamp electrically connected to the second switch, and operable to illuminate only when the second switch is in the second on position;

wherein said means for illuminating the fourth indicia includes a fourth lamp electrically connected to the second switch, and operable to illuminate only when the second switch is in the first on position; and wherein said front panel is opaque, and said first, second, third and fourth indicia include openings formed through the opaque panel to permit light passage therethrough upon illumination of an associated lamp.

9. The display apparatus of claim 8, further comprising colored translucent panels positioned between the indicia and the lamp associated with the indicia, to illuminate said indicia in color.

10. The display apparatus of claim 9, further comprising a first light baffle between the first and second lamps, a second light baffle between the second and third lamps, and a third light baffle between the third and fourth lamps, said baffles substantially isolating light from the lamps with their associated indicia.

* * * * *